US007320463B2

(12) United States Patent
Langenegger

(10) Patent No.: US 7,320,463 B2
(45) Date of Patent: Jan. 22, 2008

(54) DEVICE FOR FEEDING A PROCESSING SECTION

(75) Inventor: Daniel Langenegger, Brittnau (CH)

(73) Assignee: Muller Martini Holding AG, Hergiswil (CH)

( * ) Notice: Subject to any disclaimer, the term of this patent is extended or adjusted under 35 U.S.C. 154(b) by 355 days.

(21) Appl. No.: 10/848,140

(22) Filed: May 19, 2004

(65) Prior Publication Data

US 2004/0245713 A1 Dec. 9, 2004

(30) Foreign Application Priority Data

May 20, 2003 (EP) ..... 03405348

(51) Int. Cl.
*B65H 5/00* (2006.01)

(52) U.S. Cl. ..... 271/10.04; 271/10.01; 271/11; 271/12; 271/10.05

(58) Field of Classification Search ..... 271/10.01, 271/11, 12, 10.04, 10.05, 10.06, 10.07, 10.09, 271/10.1, 99, 100, 101, 102
See application file for complete search history.

(56) References Cited

U.S. PATENT DOCUMENTS 3,661,380 A * 5/1972 Muller ..... 271/14
4,358,100 A * 11/1982 Muller ..... 271/11
4,491,311 A * 1/1985 Glanzmann ..... 270/52.27
4,606,235 A * 8/1986 Kindt ..... 74/113
4,993,702 A * 2/1991 Jackson ..... 271/270
5,174,559 A * 12/1992 Diamantides ..... 271/12
5,531,433 A * 7/1996 Hawkes et al. ..... 271/10.01
5,906,134 A * 5/1999 Yamada ..... 74/436
6,193,229 B1 * 2/2001 Hall et al. ..... 271/109
6,375,179 B1 * 4/2002 Boss et al. ..... 270/52.27
6,601,844 B2 * 8/2003 Ballestrazzi et al. ..... 271/100
6,623,000 B2 * 9/2003 Hall ..... 271/11
6,726,201 B2 * 4/2004 Studer ..... 271/204
6,758,469 B2 * 7/2004 Muller ..... 271/100

FOREIGN PATENT DOCUMENTS

| | | |
|---|---|---|
| DE | 1 092 934 | 11/1960 |
| DE | 1 220 387 | 7/1966 |
| EP | 0 526 946 | 2/1993 |
| EP | 1 186 558 | 3/2002 |

* cited by examiner

*Primary Examiner*—Patrick Mackey
*Assistant Examiner*—Gerald W McClain
(74) *Attorney, Agent, or Firm*—Venable LLP; Robert Kinberg

(57) ABSTRACT

A device for feeding a processing section with printed products includes a magazine and a feeding mechanism that includes a gripping mechanism and a conveying mechanism for removing the printed products from the magazine and feeding them to the processing section. The gripping mechanism and the conveying mechanism are driven so that the gripping mechanism can be accelerated in an angular region for a catch-up operation while the speed of the conveying mechanism remains constant.

13 Claims, 6 Drawing Sheets

DEVICE FOR FEEDING A PROCESSING SECTION

CROSS-REFERENCE TO RELATED APPLICATION

This application claims the priority of European Patent Application No. 03405348.8, filed on May 20, 2003, the subject matter of which is incorporated herein by reference.

BACKGROUND OF THE INVENTION

The invention relates to a device for feeding a processing section with printed products, in particular folded or non-folded printed sheets. Such a device includes a magazine and a feeding mechanism which is provided with gripping means and conveying means for removing the printed products from the magazine and feeding them to the processing section.

A device of this type is disclosed, for example, in European Patent Application EP-1 186 558 A, co-owned by the assignee of the present application, where folded or non-folded printed products are withdrawn from a stack with the aid of a rotating drum and are then supplied to a collecting channel. The printed products are supplied directly, without change in direction, to the collecting channel. The device operates based on the so-called principle of withdrawal in longitudinal direction, wherein the withdrawal direction is also the transporting direction of the processing section. The printed sheets are used to produce books, brochures, magazines or similar printed products.

The mechanical configuration of such a device is generally based on the configuration for a drum feeder with individual drive. The drum circumference essentially corresponds to the division for the processing section, e.g. a gathering chain. Processing sections of this type are used, for example, for producing books in adhesive binding machines. Standard divisions for such processing sections are 24" and 18," but other divisions such as a 20" division are possible as well. With a 24" division, the drum circumference is normally 200 mm and the production output is approximately 15'000 cycles/hour. A correspondingly higher production output of 18'000 cycles/hour is standard for a processing section with 18" collecting chain and 18" drum feeder. If a plant has adhesive binding machines with different chain divisions, for example 24" and 18," correspondingly different drum feeders, in this case 24" and 18" drum feeders, are required for the optimum production capacity, so that the circumferential speed of the drum corresponds to the respective chain speed.

A device for a 24" collecting chain could be adapted to an 18" chain by installing a delay drive to achieve a correspondingly higher production output. The delay drive would have to be adjusted so as to adapt the transfer of the printed products to the division and speed of the processing section. The rotating driving device and/or the withdrawing drum would have to start at the slower speed, but would then have to be accelerated so that the following withdrawal operation could again start synchronized with the cycle. A speed change of this type, however, would endanger the process safety. Alternatively, the withdrawal drum could also be replaced with a drum having a smaller diameter. However, with a smaller drum diameter, e.g. 150 mm, the disadvantage would be that accommodating the gripping organ and the required mechanical elements would be difficult.

SUMMARY OF THE INVENTION

It is an object of the present invention to create a device of the aforementioned type which avoids the above-mentioned disadvantages and can be used for different types of processing sections with different divisions while operating at optimum production capacity, while still being cost-effective to produce.

The above and other objects are accomplished according to one exemplary embodiment of the invention wherein there is provided a device for feeding a processing section with printed products, comprising: a magazine; and a feeding mechanism including gripping means and conveying means for removing the printed products from the magazine and feeding them to the processing section, the gripping means and the conveying means being driven so that the gripping means can be accelerated in an angular region for a catch-up operation while the speed of the conveying means remains constant.

When using a processing section with the large chain division, for example 24," the device operates in the known manner. The gripping means and the conveying means are fixedly connected over the complete angle region. However, if the processing section used has a smaller chain division, for example 18," the device can be switched or converted easily by respectively accelerating the gripping means on the basis of a predetermined angular region. This acceleration allows the gripping means to catch up with the rotation that is lacking with each cycle, helped by the fact that only a small angle window of, for example, 128° is generally required for the withdrawal operation and the catch-up can occur over a 232° distance. The device consequently can achieve the output of a processing section with shorter division, for example 18'000 cycles/hour with a 18" division. Since it is not necessary to reduce the circumference of the feeding device and/or the feeding drum, the required gripping elements and mechanisms can be accommodated without problems.

Another advantage is seen in the fact that no speed changes are required for the transport of the printed products, which would endanger the process safety as mentioned in the above. For a plant having several systems, for example adhesive binding machines with two different divisions, the device according to the invention can be used for all systems, respectively with the optimum capacity. For example, it is possible to have a production rate of 15'000 cycles/hour with systems having a 24" division and 18'000 cycles/hour with a system having an 18" division.

A particularly simple and operationally safe system is achieved if the stepping mechanism is a Geneva drive. This type of embodiment is based on the finding that the above-mentioned standard 24" and 18" divisions behave as 4 to 3. A feeder drum for a 24" division (609.6 mm) executes one rotation per cycle while a drum for an 18" division (457.2 mm) executes only ¾ of a rotation. With a 24" feeder drum, the withdrawal operation for an 18" processing section is always late by ¼ of a rotation. A Geneva drive thus allows compensating for the missing part of the gripping means rotation with an 18" division.

The circumferential speed of the conveying element corresponds to the speed of the processing section. Since the conveying element is designed for a 24" division and the division of the processing section is only 18," the conveying element speed amounts to three-fourth of the speed of a conveying element for a processing section with a 24" division with the same circumference. The conveying element with 18" division and 18'000 cycles/hour therefore rotates slower than a conveying element for a 24" processing section with 15'000 cycles/hour, thus making the withdrawal operation slower as well. As a result, the kinetic-static conditions for all relevant movements, e.g. of the suctioning equipment, the retaining devices, and the gripping mechanisms, become more favorable and are in particular operationally safer, meaning a higher safety is achieved simultaneously with a higher output.

Essential advantages of the device according to the invention are also seen in that an extremely compact mechanical design is possible and that this device can optionally be used with an 18" collecting chain or a 24" collecting chain while having the same components.

Particularly suitable for this is a 4-finger internal Geneva drive for which the operation is synchronized at 90° and the catch-up operation can be distributed over 180°, relative to the conveying element, thus allowing particularly soft transitions.

This invention furthermore relates to a device having a processing section for depositing printed products in a collecting channel on the basis of the principle of withdrawal in longitudinal direction.

BRIEF DESCRIPTION OF THE DRAWINGS

One exemplary embodiment of the invention is explained in further detail in the following with the aid of the drawing.

DETAILED DESCRIPTION OF THE INVENTION

Figure 1:
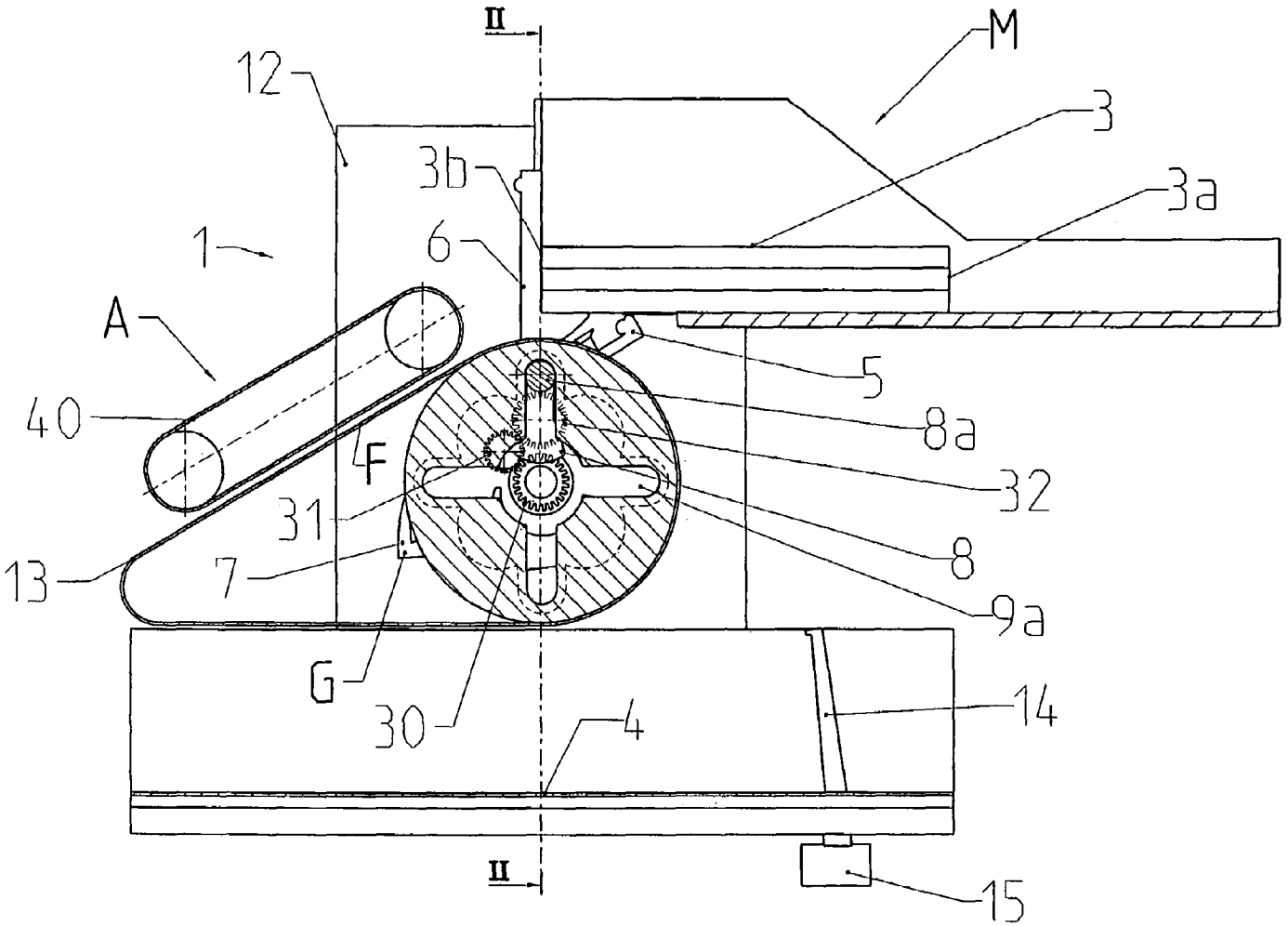
FIG. 1 is a section through the device according to the invention, along the line I-I in FIG. 2.
Figure 2:
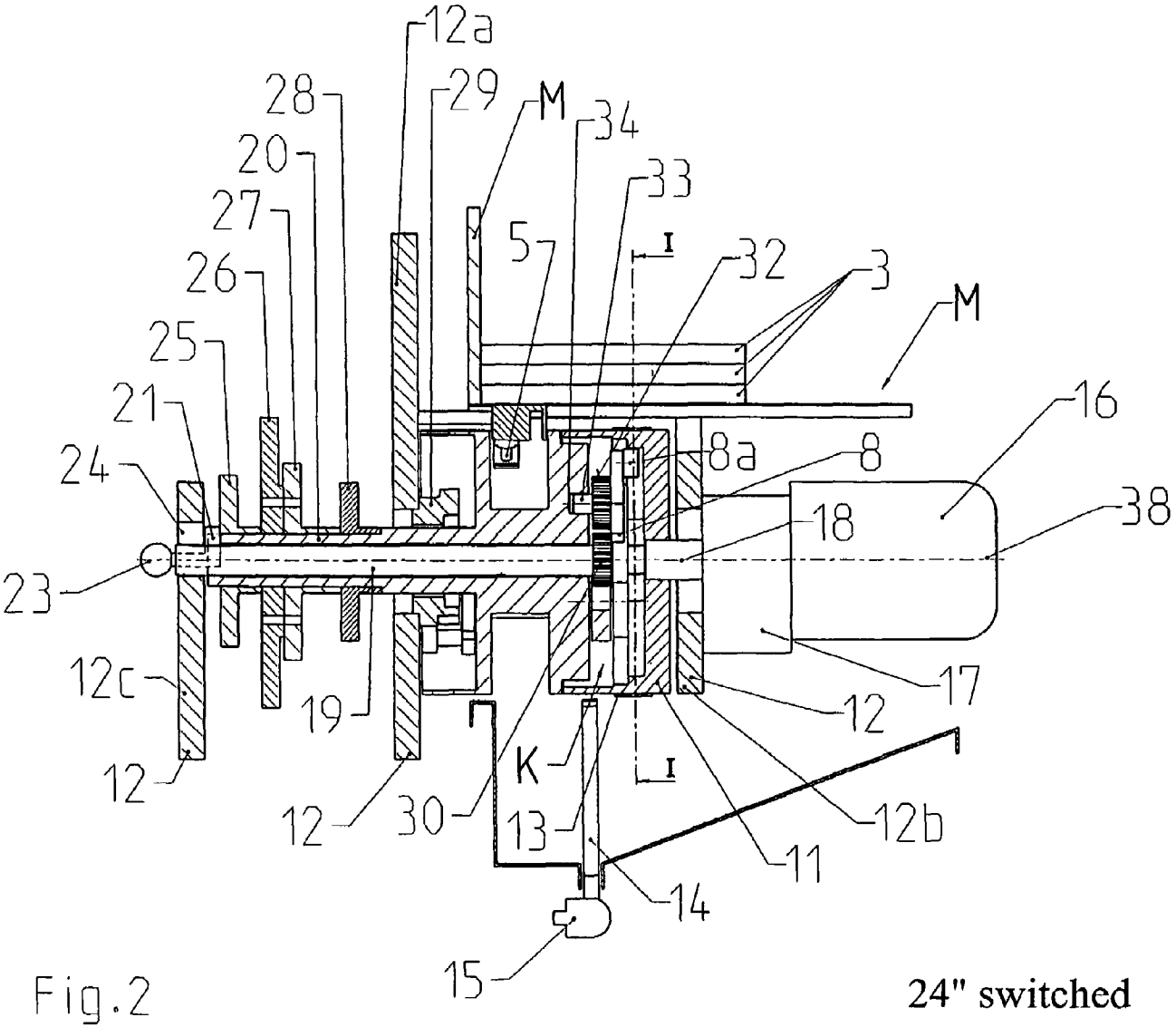
FIG. 2 is a section in the axial direction through the device according to the invention, along the line II-II in FIG. 1.
Figure 3:
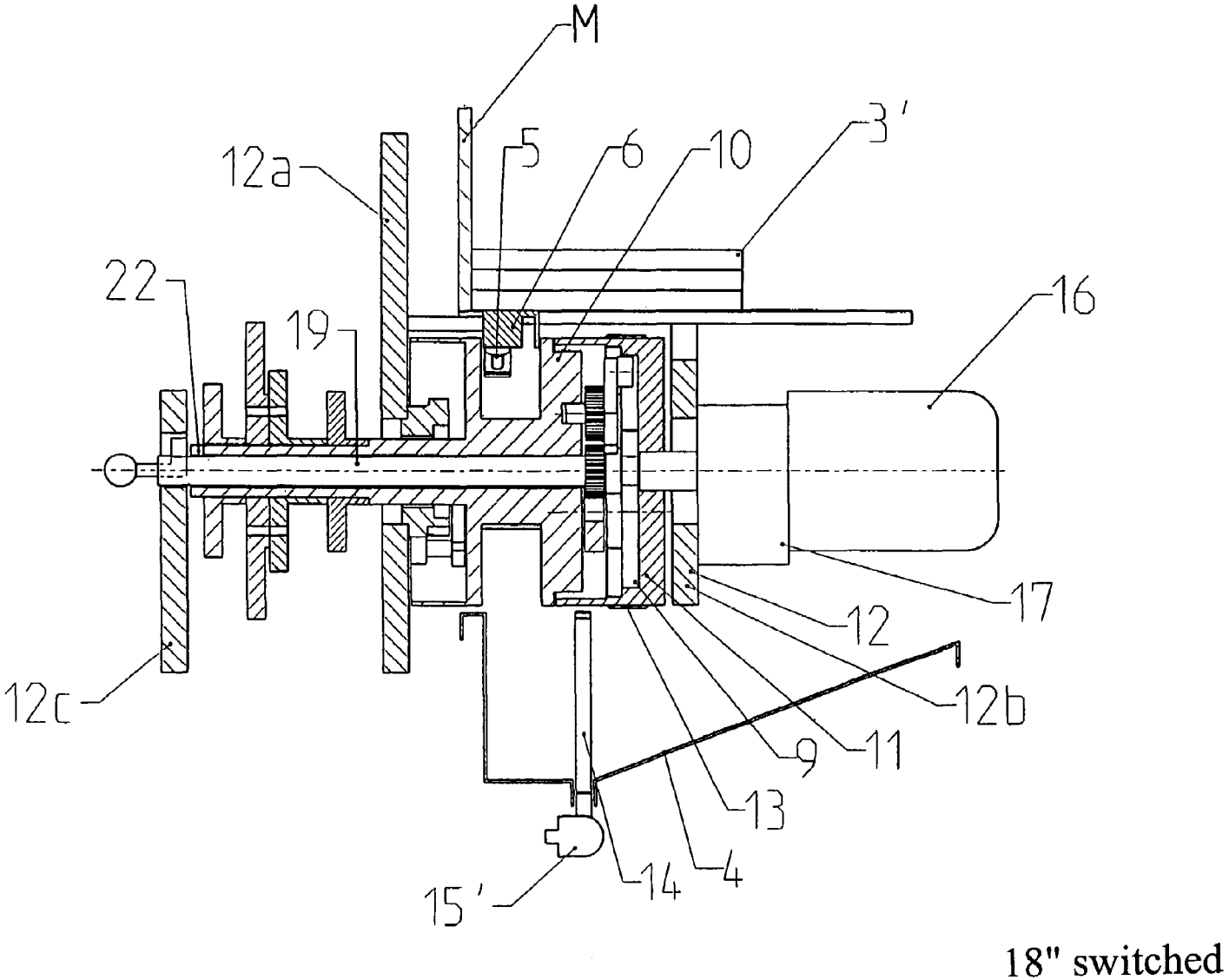
FIG. 3 is a section similar to FIG. 1, but following the conversion to a different division.
Figure 4:
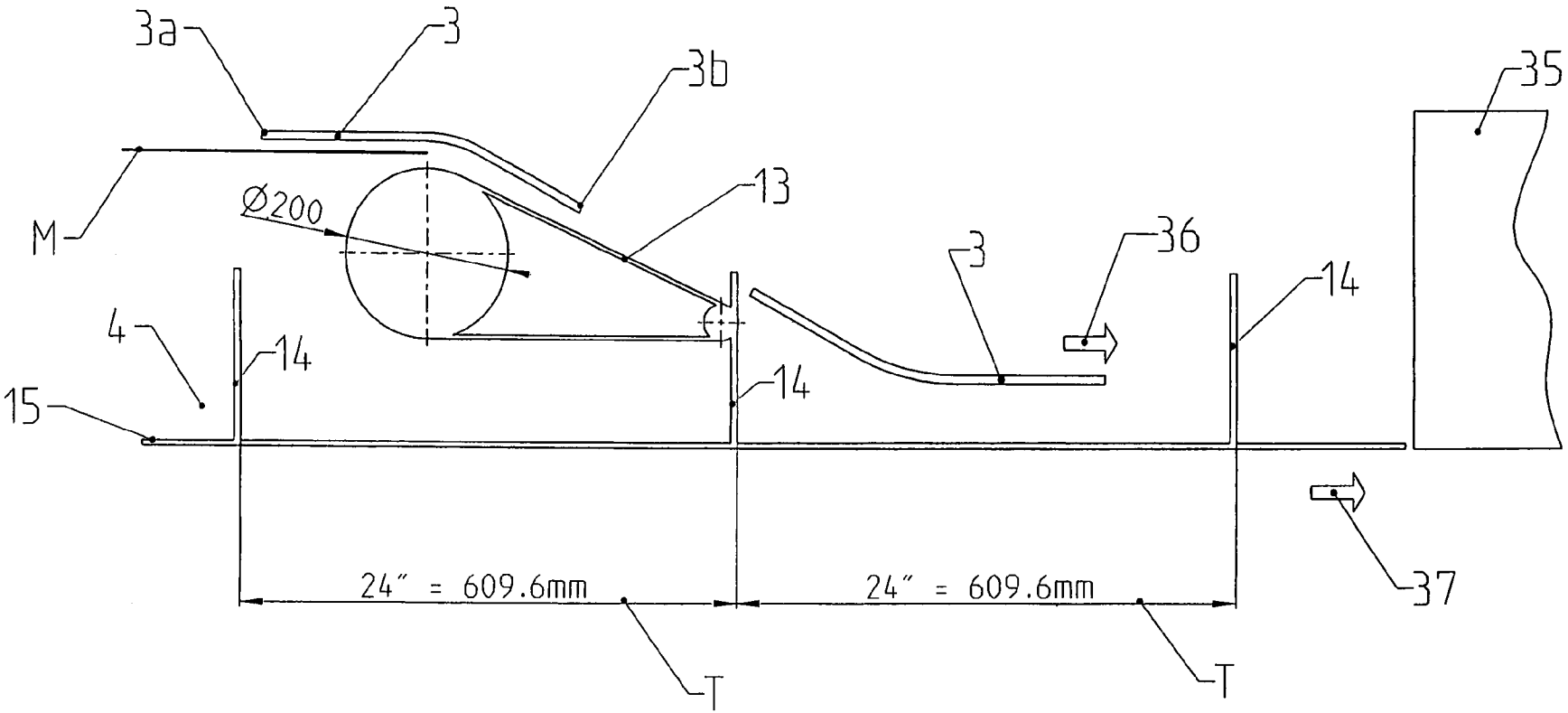
FIG. 4 is a schematic which shows the depositing of a printed product in a collecting channel.
Figure 5:
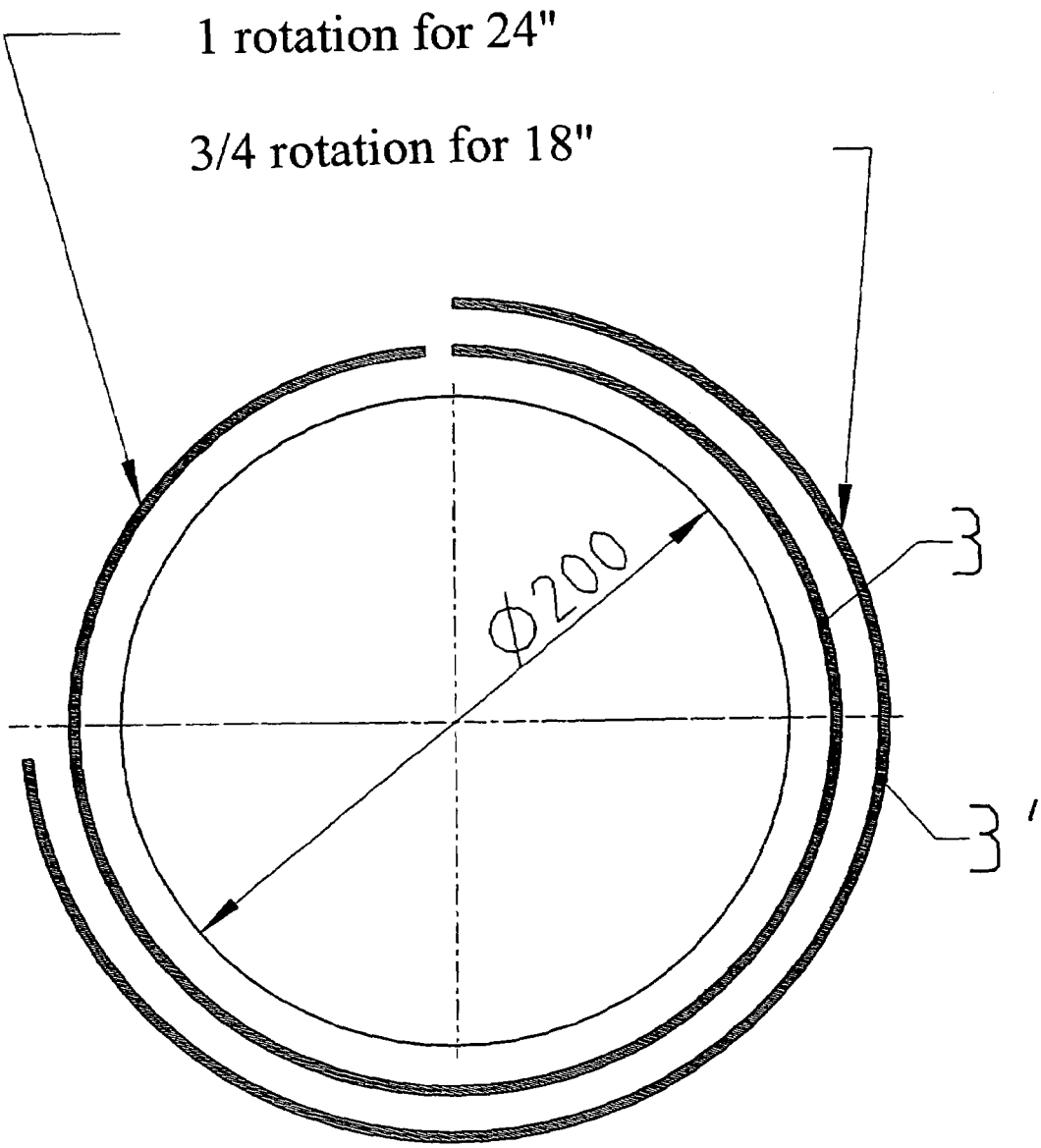
FIG. 5 is a schematic which shows the rotations for the 24" and/or the 18" divisions.

Referring to FIGS. 1-3, there is shown a device 1 for feeding a processing section. Device 1 includes a magazine M where printed products 3 are stacked one above the other. Printed products 3 are, in particular folded or non-folded printed sheets, for example used for producing books, brochures, magazines or the like. For this, printed products 3 are respectively withdrawn individually from magazine M with the aid of a feeding device A and are then deposited in a collecting channel 4, as shown in FIG. 4. Collecting channel 4 is provided with a collecting chain 15, comprising pushers 14, e.g. spaced apart by 24" or 18", in particular an endless link chain. Collecting chains 15 of this type are well known to the person skilled in the art and need not be explained further herein. The spacing between adjacent pushers 14 corresponds to the above-mentioned division, for example 24" or 18," wherein other divisions are also possible. FIG. 4 shows a division T of 24" for a collecting chain 15.

Device 1 operates based on the so-called principle of withdrawal in longitudinal direction. The direction in which printed product 3 is transported by feeding device A essentially corresponds to the transporting direction of collecting chain 15, which is shown schematically in FIG. 4. The direction of arrow 36, which indicates the transporting direction of the printed product 3 prior to the deposit, therefore corresponds to the direction of arrow 37 that indicates the transporting direction of the collecting channel 4. The top edge is given the reference 3*a* and the bottom edge the reference 3*b*. The division T is adapted to the spacing between top edge 3*a* and bottom edge 3*b*.

The operation of feeding device A is synchronized with that of collecting chain 15, wherein a printed product 3 is deposited between respectively two pushers 14. Printed products 3 that are deposited in collecting channel 4 are supplied, for example, to an adhesive binding machine 35, which is only indicated in FIG. 4, or to a different processing section.

Feeding device A essentially consists of a conveying means F and a gripping means G. With the aid of gripping means G, printed products 3 are respectively pulled individually from the stack in magazine M and the gripped printed products 3 are then transported with conveying means F to collecting channel 4.

Gripping means G comprises a gripping drum 10, which is provided on a hollow shaft 20 with control cams 25 to 29 with corresponding control curves. The control cams 25 to 28, which are fixedly connected to the hollow shaft 20, and the control cam 29 that is attached to frame 12 function to control the means, known per se, for withdrawing and gripping the printed products 3. Control cam 25 controls vacuum valves that are not shown herein, control cam 28 controls suction devices 5, control cam 27 controls a retaining device 6 that is shown in FIG. 1, control cam 26 controls a spot roller that is known per se and is not shown herein and control cam 29 controls at least one gripper 7.

The conveying means F comprise a conveying drum 11, which is driven by a motor 16, with synchronous timing to collecting chain 15, wherein the motor is provided with a gear 17 and is preferably a servomotor. Placed around conveying drum 11 is an endless conveying belt 13 that operates jointly with a different conveying belt 40 for transporting the withdrawn printed products 3. Gripping drum 10 and conveying drum 11 are positioned on frame 12 that is provided with bearing plates 12*a* and 12*b*. A different bearing plate 12*c* of the frame 12 functions to position a shaft 19 which can be connected rotationally secure to a hollow shaft 20 and thus also to gripping drum 10 or bearing plate 12*c* by adjusting a pusher cam 21. Pusher cam 21 can be displaced in the axial direction with a projecting grip 23. In the one position, the pusher cam 21 engages in a slot 22 in hollow shaft 20, while in the other position the pusher cam 21 is located outside of the slot 22, in a recess 24 in bearing plate 12*c*. In the position shown in FIG. 2, shaft 19 thus rotates along with the gripping drum 10 and in the position shown in FIG. 3, shaft 19 is connected to frame 12, such that it cannot rotate. The pusher cam 21 could also be replaced with another suitable connecting means.

Conveying means F and gripping means G are connected by means of an internal Geneva drive K. The internal Geneva drive K, known per se, has a crank 8 that is provided at a distance to the axis of rotation 38 with a roll 8*a* which engages in slots 9*a* of the Geneva drive. As can be seen, Geneva wheel 9 is a four-finger internal Geneva wheel. However, the internal Geneva drive K shown herein is only one coupling example and is used, in particular, for a stepping mechanism. The conveying drum 11 in this case represents the driving member and the gripping drum 10 represents the output gear.

Crank 8 is additionally provided at a distance to rotational axis 38 with a toothed gear 32 which is fixedly connected to the crank 8 and engages with a pin 33 in a blind hole 34 of the gripping drum 10. The axis of pin 33 forms the rotational axis for the crank 8 and can move along a circular course, with the center point being on the axis of shaft 19. For a change in direction, the toothed gear 32 meshes with an intermediate gearwheel 31, shown in FIG. 1, which is attached to the gripping drum 10 and which in turn meshes with a gearwheel 30 that is connected to the shaft 19, so as to rotate along. The gearwheels 32 and 30 are positioned at a ratio of 1:1 to each other.

If the pusher cam 21 is in the position shown in FIG. 3, the crank 8 transmits the rotation of the conveying drum 11 in an angular region to the gripping drum 10, such that it is accelerated, which is the case if the roll 8*a* engages in one of the four slots 9*a* of the Geneva wheel 9. If the roll 8*a* is not engaged in the slot 9*a*, then the gripping drum 10 is driven with the same speed and in the same direction as the conveying drum 11.

Figure 6:
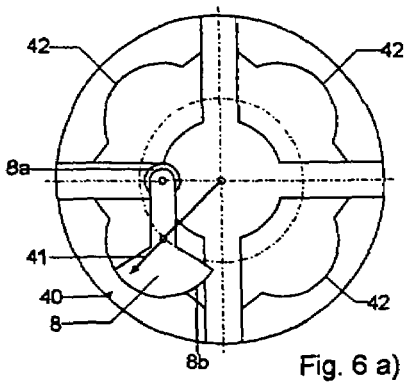
FIGS. 6*a*) to 6*g*) are schematics which show a machine cycle of 360° for the gripper drum.
Figure 6:
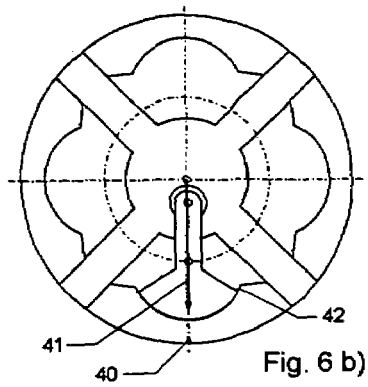
Figure 6:
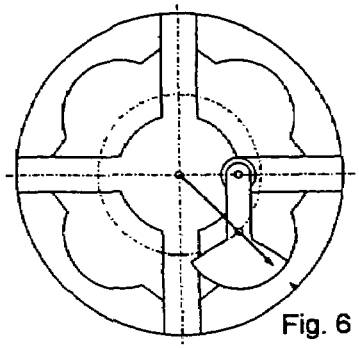
Figure 6:
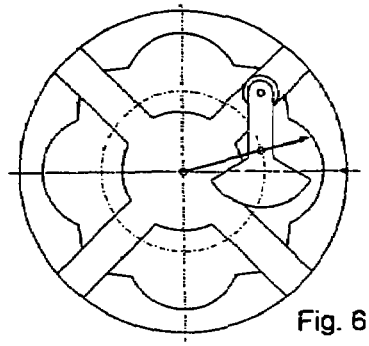
Figure 6:
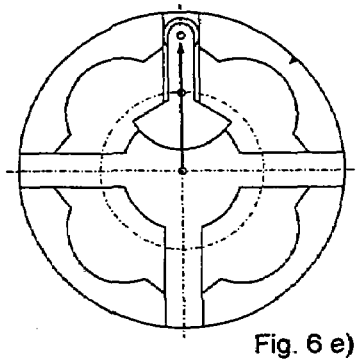
Figure 6:
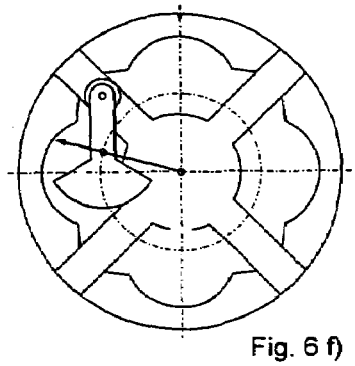
Figure 6:
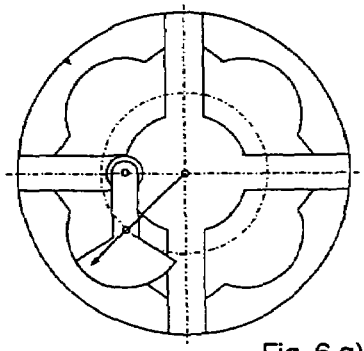

The mode of operation of the Geneva drive is explained with the aid of FIGS. 6*a*) to 6*g*). The reference point 40 shows the position of conveying drum 11 and an indicator 41 shows the position of the gripping drum 10. In the starting position shown in FIG. 6 *a*), roll 8*a* moves out of the slot of the Geneva wheel and the coupling of the gripping drum 10 occurs directly with the aid of circular segment 8*b* of crank 8, with the recess 42 in the conveying drum 11. After the gripping drum 10 is driven angle-synchronous by the conveying drum 11, from 0° to 90° as shown in FIGS. 6 *a*) to 6 *c*), the coupling takes place as shown in FIGS. 6 *c*) to 6 *g*) via the roll 8*a* of crank 8, which is guided inside the slot of the Geneva wheel. In this phase, the conveying drum 11 traverses a distance of 180° and the gripping drum 10 traverses a distance of 270° meaning the gripping drum 10 traverses 360° during the three-fourth rotation of the conveying drum 11.

If pusher cam 21 is in the position shown in FIG. 2, gripping drum 10 is always fixedly connected to conveying drum 11, so that both drums 10 and 11 rotate with the same speed. Crank 8 in that case only has a locking function and could be replaced, for example, with a simple bolt. Roll 8*a*, for example, always remains inside one of the slots 9*a*.

Two gear shifting positions are therefore possible, depending on the position of the pusher cam 21. These can be adjusted through a simple displacement of pusher cams 21 on handle 23. For the gear shifting position according to FIG. 2, conveying drum 11 and the gripping drum 10 are always fixedly connected, as explained in the above. With the gear shifting position according to FIG. 3, gripping drum 10 is driven so as to be accelerated in one angular region. The gear shifting position according to FIG. 2, for example, is used for a division of 24" and the position shown in FIG. 3 is used for a division of 18."

In the gear shifting position according to FIG. 2, printed products 3 are withdrawn in the known manner by operating suction devices 5, grippers 7 and retaining device 6 and are then deposited in collecting channel 4. Suction devices 5 and grippers 7 grip one printed product 3 following each rotation of the gripping drum 10 and this product is subsequently deposited by conveying means F in collecting channel 4, e.g. with a conveying speed of 15'000 cycles/hour. In that case, the internal Geneva drive K does not have a gear function. Crank 8 could, as mentioned in the above, be replaced with a bolt which rotationally connects the conveying drum 11 to gripping drum 10. A conversion through replacing the crank 8 with the aforementioned bolt would be comparably simple.

With the gear shifting position shown in FIG. 3, internal Geneva drive K operates so that in a first angular region, e.g. approximately 90°, conveying drum 11 and/or conveying means F rotate jointly with gripping drum 10 and/or gripping means G. Suction devices 5, grippers 7 and retaining device 6 are effective in this angular region and/or angle window. Printed products 3' are withdrawn in the same way as shown for the gear position in FIG. 2. Following this first angle region and/or angle window, gripping drum 10 is driven so as to be accelerated by conveying drum 11. For example, gripping drum 10 is accelerated in this angular region of approximately 180° of the conveying drum, such that it traverses an angular distance of 270°. As a result, the rotation of gripping drum 10 catches up to the rotation of conveying drum 11 by 90° and the gripper 7, following a rotation of 360° of the gripping drum, can grip the following printed product 3'. Conveying drum 11 in that case is driven with a constant speed and with synchronous timing to conveying chain 15. Thus, the missing one-fourth rotation is made up while the product is transported by conveying means F.

The transport of printed products 3' is not affected by this catch-up maneuver of gripping drum 10 and thus continues at a constant speed. The transporting speed of printed products 3' here corresponds to the transporting speed of collecting chain 15' with 18" division. Since the feeding device A is designed, for example, for a division of 24," the rotational speed of conveying drum 11 is only three-fourths of the speed that is required for use with a 24" collecting chain 15. For an 18" division and 18'000 cycles/hour, the feeding device A rotates slower than for the gear position according to FIG. 2, which operates with a 24" collecting chain 15 at 15'000 cycles/hour. The essential advantage of this is that the kinetic-static conditions for all movements of suction devices 5, grippers 7 and retaining device 6 are more favorable. If a four-finger internal Geneva drive K is used, the aforementioned catch-up operation can be distributed over at least 180°, thus ensuring a soft transition.

Device 1 can therefore be used for two different divisions, for example for a 24" or 18" division of a processing section. The switchover can occur simply and quickly with a switching operation at handle 23. A reconfiguring of device 1 is possible, but is not necessary. If a collecting chain 15 and/or 15' is used, pushers 14 must be arranged at the appropriate spacing for adapting them to the division.

Essential is therefore the catch-up operation of gripping means G and/or gripping drum 10 with each withdrawal operation. In place of the above-mentioned drive with a motor 16 and a stepping mechanism between conveying drum 11 and gripping drum 10, two motors which are not shown herein could also be used for this, wherein the one motor drives conveying drum 11 and the other motor drives gripping drum 10. By using a suitable control for the motors, a drive corresponding to the stepping mechanism would also be possible.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A device for feeding a processing section with printed products, comprising:

a magazine; and a feeding mechanism including gripping means and conveying means for removing the printed products from the magazine and feeding them to the processing section, the gripping means and the conveying means being driven so that the gripping means can be accelerated in an angular region for a catch-up operation while the speed of the conveying means remains constant, wherein the device is used for the withdrawal of printed products in a longitudinal direction of transport of a collecting section and can be switched or remodeled so that, in a first gear position of the feeding mechanism, the device is operative for a first division of the collecting section and, in a second position, the device is operative for a second division of the collecting section.

2. The device according to claim 1, wherein the first division is 24 inches and the second division is 18 inches.

3. The device according to claim 1, wherein the feeding mechanism includes a stepping mechanism connecting the gripping means and the conveying means to each other.

4. The device according to claim 3, wherein the stepping mechanism is a Geneva drive.

5. The device according to claim 1, wherein the conveying means comprises a conveying drum and the gripping means comprises a gripping drum.

6. The device according to claim 4, wherein the Geneva drive is an internal Geneva drive.

7. The device according to claim 4, wherein the Geneva drive is a four-finger drive.

8. The device according to claim 1, wherein the feeding mechanism includes a shaft arranged in the gripping means and means for connecting the shaft to the gripping means or to a frame in a switching operation.

9. The device according to claim 8, wherein the feeding mechanism includes a crank connected to one end of the shaft.

10. The device according to claim 9, wherein the feeding mechanism includes a first toothed wheel connected to the crank, an intermediate, second toothed wheel and a third toothed wheel connected to the one end of the shaft and which meshes with the first toothed wheel via the intermediate, second toothed wheel.

11. A device for feeding a processing section with printed products, comprising:

a magazine; and a feeding mechanism including gripping means and conveying means for removing the printed products from the magazine and feeding them to the processing section, the gripping means and the conveying means being driven so that the gripping means can be accelerated in an angular region for a catch-up operation while the speed of the conveying means remains constant, wherein the feeding mechanism includes a shaft arranged in the gripping means and means for connecting the shaft to the gripping means or to a frame in a switching operation.

12. The device according to claim 11, wherein the feeding mechanism includes a crank connected to one end of the shaft.

13. The device according to claim 12, wherein the feeding mechanism includes a first toothed wheel connected to the crank, an intermediate, second toothed wheel and a third toothed wheel connected to the one end of the shaft and which meshes with the first toothed wheel via the intermediate, second toothed wheel.

* * * * *